United States Patent [19]

Andersen et al.

[11] 4,190,160

[45] Feb. 26, 1980

[54] ACCIDENT RESISTANT TRANSPORT CONTAINER

[75] Inventors: John A. Andersen; James K. Cole, both of Albuquerque, N. Mex.

[73] Assignee: The United States of America as represented by the United States Department of Energy, Washington, D.C.

[21] Appl. No.: 18,098

[22] Filed: Mar. 6, 1979

[51] Int. Cl.[2] ..... B65D 81/04; B65D 81/06; B65D 85/30

[52] U.S. Cl. ..... 206/591; 206/592; 206/593; 220/466; 220/468; 220/256

[58] Field of Search ..... 206/591, 583, 521, 592, 206/593; 220/254, 256, 319, 320, 325, 466, 468

[56] References Cited

U.S. PATENT DOCUMENTS

| | | | |
|---|---|---|---|
| 1,575,681 | 3/1926 | Griffiths | 220/466 |
| 2,005,248 | 6/1935 | Thompson | 220/466 |
| 2,099,113 | 11/1937 | Hollnagel | 220/468 |
| 3,500,996 | 3/1970 | Gorman | 206/583 |

*Primary Examiner*—William T. Dixson, Jr.
*Attorney, Agent, or Firm*—R. V. Lupo; Dudley W. King; Robert Southworth, III

[57] ABSTRACT

The invention relates to a container for the safe air transport of plutonium having several intermediate wood layers and a load spreader intermediate an inner container and an outer shell for mitigation of shock during a hypothetical accident.

5 Claims, 7 Drawing Figures

ACCIDENT RESISTANT TRANSPORT CONTAINER

FIELD OF THE INVENTION

The invention relates to a container for the safe transport by air, rail, truck or otherwise of fissile materials, such as a plutonium dioxide.

BACKGROUND OF THE INVENTION

Air transport is often desired for the controlled movement of small high-value items because of the superior safety record and enhanced safeguards and accountability of air transport. In the nuclear industry, small high-value items might include plutonium oxide shipments.

Prior art shipping containers as exemplified by U.S. Pat. Nos. 3,369,121; 3,432,666; 3,608,769, and 3,982,134 have been deemed wanting in one or more respects in ability to survive severe aircraft crash. A hypothetical aircraft accident test procedure calls for an impact of about 250 knots onto an unyielding surface followed by various crushing, puncturing, and slashing tests which in turn are followed by a one-hour fire in aviation fuel. To successfully survive this test, a container must not leak and must not pose a threat because of exterior radiation or nuclear criticality.

In addition to the need to survive such a severe crash environment, a transport container must not use unreasonable amounts of volume or materials since both volume and weight aboard an aircraft are at a premium.

SUMMARY OF THE INVENTION

In view of difficulties and disadvantages such as noted above, it is an object of this invention to provide a novel container for the transport of hazardous material.

It is a further object to provide a container for the transport of plutonium compounds which is safe even in aeronautical accidents.

It is still further object of this invention to provide a safe, transportable container for fissile materials which is economical of both volume and material.

The invention comprises an improved container for hazardous materials such as plutonium compounds having an outer steel housing, a metal load spreading tube housed within, and wood fillers intermediate the load spreader and the contents to be transported.

DETAILED DESCRIPTION OF THE INVENTION

Figure 1:
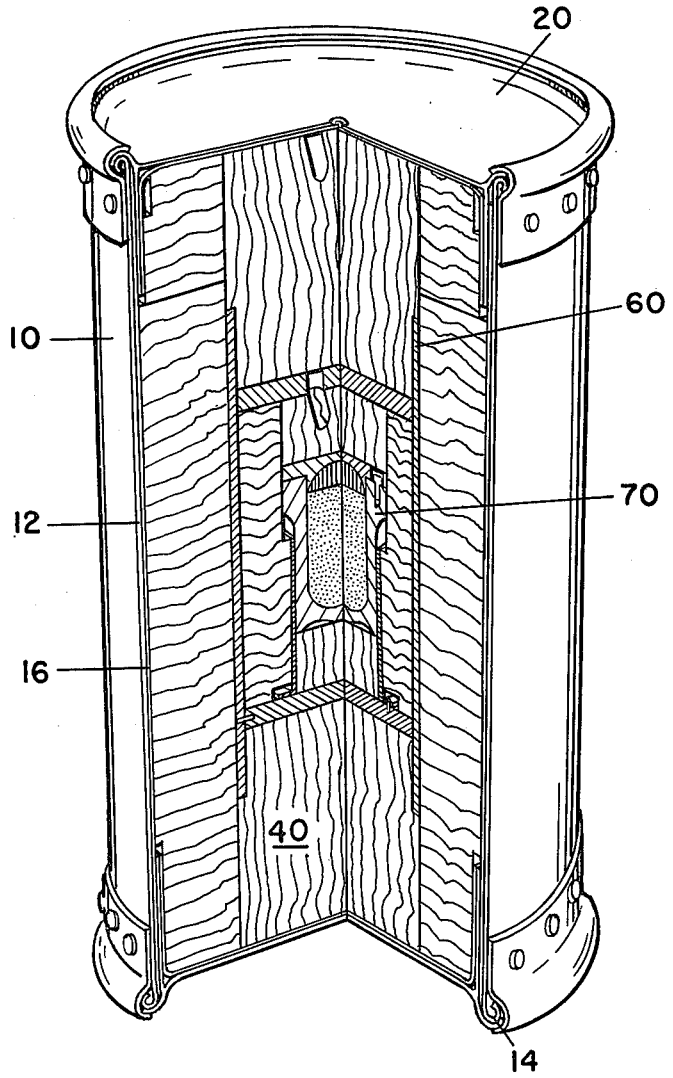
FIG. 1 illustrates in cross section a preferred embodiment of the invention.

Reference is now made to FIG. 1 which illustrates in cross section a preferred embodiment of the invention. In broad outline, the invention comprises an outer steel housing 10, special end enclosures 20, a load spreading assembly 60, various wood fillers 40, and an inner vessel assembly 70. The cooperation of all of these elements, in subtle and non-obvious ways, is required to meet the very stringent safety standards. Such a container has a gross weight of about 500 pounds and is a cylinder about 24½ inches outside diameter and about 42½ inches in height.

As shown, the tubular steel housing 10 comprises an outer drum 12 with a drum liner 16 bonded to the interior. The outer drum 12 may be a 65 gallon drum of 16 gauge type 304 stainless steel having a length of 41½ inches and an inside diameter of 22½ inches. Each end of this drum has a rolled strengthening ridge or chime 14 to accommodate the particular end assemblies described hereinafter. Standard drum end closures such as clamped top lids or rolled and crimped or all-welded bottom end have been deemed not strong enough to survive a severe accident. Stainless steel is preferred over standard carbon steel for its increased toughness. To further augment the strength of this drum, a 12 gauge type 304 stainless steel liner 16 is bonded to its interior. A satisfactory bonding material is polyester flexibilized epoxy adhesive. One such adhesive is prepared by mixing 100 parts Uniroyal B635 resin with 15 parts Benzoflex 988 plasicizer and 9 parts Uniroyal 3080 hardener. The laminated structure affords greater resistance to tearing and penetration than would a single thickness.

Figure 2:
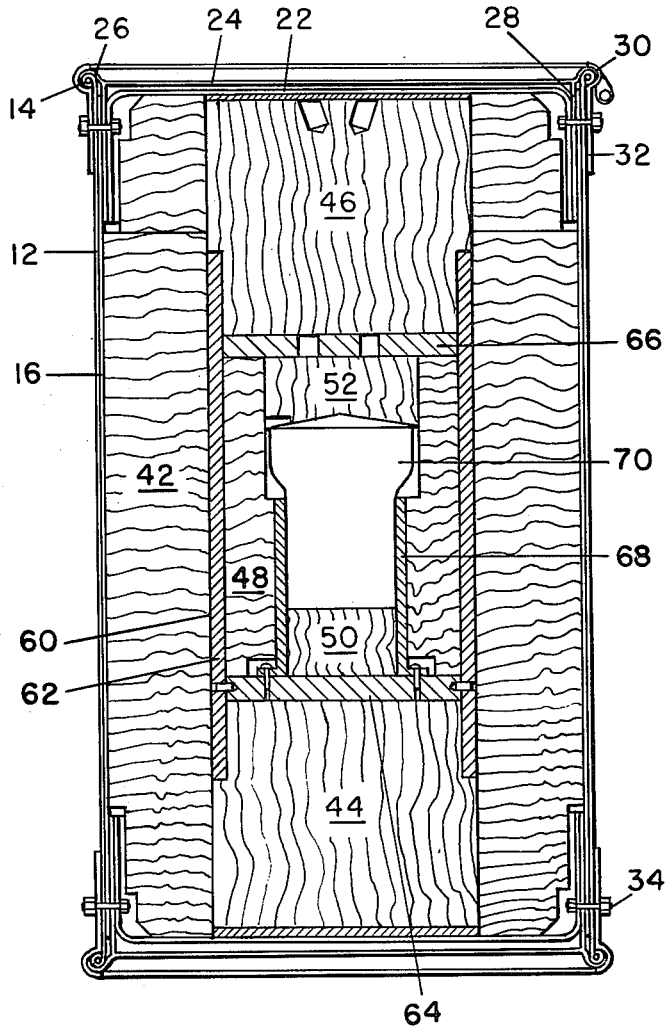
FIG. 2 illustrates in cross section various layers of the preferred embodiment.

On each end of the steel housing 10 is an end assembly 20 as shown in detail in FIG. 2. The severe crash and burn tests to which this container is subjected (and which will be more completely described hereinafter) require a very strong end closure. Several different designs, including clamped ends, rolled and crimped ends, all-welded ends, and many highly modified and strengthened ends were tested. These generally resulted in total and catastrophic failure upon impact testing. Subsequent fire tests would then burn out the interior wood fill 40 and overheat the interior container 70. The containers of the present invention ably survived the impact.

The end assembly 20 shown comprises an inner lid 22 of 16 gauge type 304 stainless steel and resembling a cylindrical dish or pan. This lid has a diameter of about 21.8 inches and is 6 inches high with a gently-rounded corner.

The end assembly further comprises an outer lid 24 having a lip 26 around its periphery which mates with the strengthening ridge or chime 14 of the outer drum 12 and also has a cylindrical skirt 28 which is positioned between the drum liner 16 and the wall of inner lid 22.

The clamp ring 30 serves to hold the lip 26 to chime 14. A ring skirt 32 is affixed to the clamp ring to further strengthen the end assembly. To complete the end assembly, bolts are inserted in 23 holes around the periphery of each clamp ring skirt. These bolts 34 penetrate the clamp ring skirt 32, the outer drum 12, the inner liner 16, the lid skirt 28, and the wall of the inner lid 22 to engage captive nuts on the inner wall of inner lid 22. This mode of fastening provides an extremely strong end fastening for withstanding severe impact.

Housed concentrically within the steel housing 10 is a load spreading assembly 60. This load spreader comprises an aluminum tube 62 which is 24 inches long with an inner diameter of 11 inches and an outer diameter of 12 inches. Because the length is only 24 inches while the height of the drum is 41½ inches, the ends of the tube do not touch the ends of the drum. Located approximately 4 inches within each end of the tube are 1-inch thick aluminum disks which span or close the diameter of the tube. The bottom disk 64 shown is fixed or secured to the tube while the top disk 66 is removable, so that the contents of the container may be reached. During impact, load spreader assembly serves to distribute inertial loading from the inner vessel assembly 70 to the various wood fillers 40. Because the disks are located inwardly of the end of the tube, there is a tendency for these disks to lock in place as the tube deforms on impact. This further strengthens the container against impact. Materials which are satisfactory for the load spreader are 6061-T6 tubular aluminum for the tube and 7075-T6 for the disks.

Housed within the load spreader tube is a heat conductor member 68 with open end to position and retain therein a vessel 70. This is a copper tube 8 inches long and 5.4 inches in diameter. The heat conductor member conducts internally-generated heat away from inner vessel 70 and towards the aluminum load spreader assembly. The copper tube may be cadmium-plated and covered with fiberglass-epoxy to prevent any galvanic corrosion of the inner vessel assembly 70.

Housed within the steel housing 10 are various wood fillers 40. These serve to absorb the energy in an impact and to act as insulation during a fire. Redwood was found to have superior specific energy absorption coupled with a favorable density (specific energy 69,900 J/kg density 360 kg/m$^3$). In producing a package with a reasonable size and a reasonable weight, redwood outranks other shock mitigators such as elastomeric and rigid forms, aluminum and stainless steel honeycombs, and other natural products such as balsa wood. Redwood also demonstrates very good performance as a thermal barrier. When confined and subjected to high heat, the outer layers will char serving to insulate those layers further in. Balsa is slightly better as a thermal barrier, but is too bulky for an air transportable container.

In order to take advantage of redwood's anisotropy (i.e., its specific energy absorption is much greater parallel to the grain than perpendicular) the various wood fillers 40 are preferably fabricated with the grain oriented in specific directions. For example, first annular member 42 which fills the space between the drum liner 16 and the load spreader tube 62 is oriented with the grain in the radial direction in order to absorb horizontal crushing. The second annular member 48 which fills the space between the spreader tube 62 and the inner vessel 70 also has radially-oriented grain. The upper and lower end fillers 44 and 46 which fill the space between the load spreader disks 64 and 66 and the end assemblies 20 and the upper and lower end fillers 50 and 52 which fill the space between the disks and the other inner vessel 70 all have vertical grain orientation to resist end-on impact.

Except for end fillers 46 and 52 which are removable, all the wood fillers are preferably bonded to adjacent metal parts using the same polyester flexibilized epoxy used to bond the outer drum 12 and drum liner 16 together. Individual wood pieces which are laminated together to form the various wood fillers may be bonded together with a polyvinyl acetate resin emulsion glue.

Figure 3:
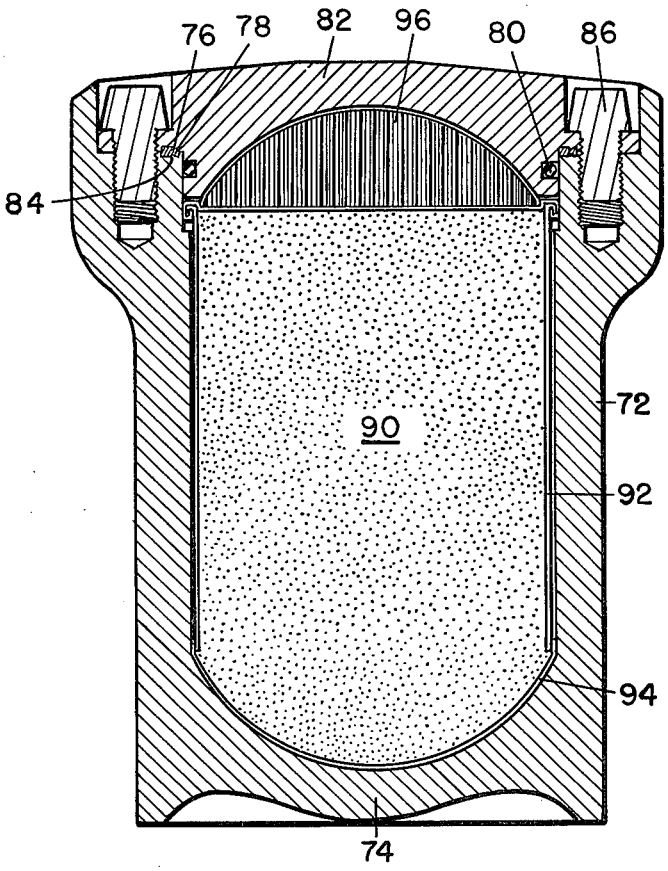
FIG. 3 illustrates in cross section an inner vessel which may be used with the present invention; and FIGS. *4a, 4b, 4c* and *4d* illustrates the appearance of a container after impact testing.
Figure 4A:
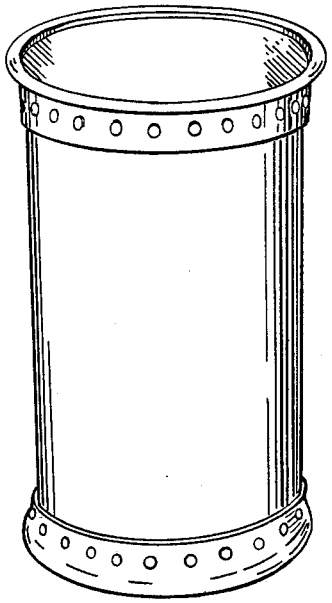
Figure 4B:
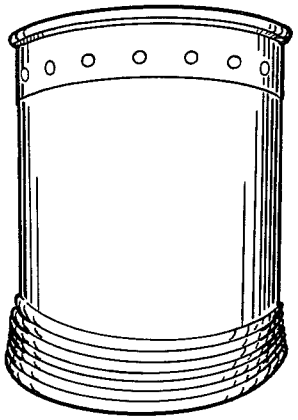
Figure 4C:
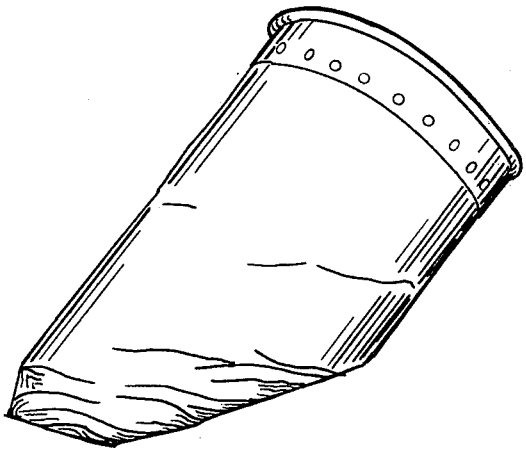
Figure 4D:
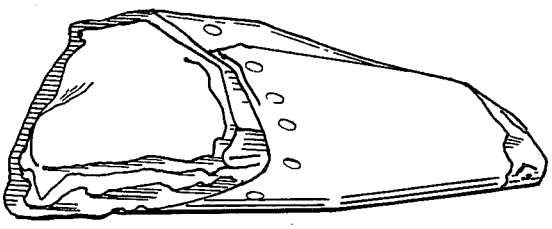

Reference is now made to FIG. 3 which shows an inner vessel assembly 70. This vessel may be used to hermetically contain substances such as $PuO_2$ which could otherwise be quite hazardous. Together with the outer containment and shock mitigation discussed hereinabove, this inner vessel makes the air transportation of such cargo safe even in severe accident conditions.

The vessel comprises a vessel body 72 with a domed bottom 74 and is constructed of stainless steel alloy PH13-8Mo and heat-treated at 1075° F. A mating dome lid 82 is fastened to the body using bolts 86 forged from high temperature alloy A-286. These bolts are silver-plated to prevent galling with the stainless steel surface. Knife edges 76 and 84 machined in corresponding surfaces of the lid and body for engaging copper gasket 78. A secondary seal is formed with a viton O-ring 80 captured between the lid and the body.

The contents 90, which may be $PuO_2$ are contained within a can 92 for convenience in containing radioactive contamination. This can is of thin-wall construction and is similar to an ordinary produce can with the exception of a hemispherical bottom 94 which matches the contour of the domed bottom of the vessel body. A hemispherical filler top 96 of aluminum honeycomb may be used to fill the space between the top of the can and the domed lid.

Further details of the container and the testing procedure including construction blueprints ae reported in NUREG/CR-0030 (SAND76-0587) which is available from the National Technical Information Service.

The above-described accident resistant container was invented to withstand heretofore unheard of severe accident conditions. Prior art containers simply cannot approach the stringent requirements met by the described container.

Prior art containers generally have been able to survive the second phase of testing, as specified by 10 CFR 71 Appendix B. These tests are designed to assess the container's ability to maintain containment, biological shielding, and subcriticality under normal conditions of transport. Tests comprise heating to 215° F. for 48 hours, cooling to −40° F. for 48 hours, pressurizing to 0.5 and 1.5 atmospheres, an 8-hour vibration test, a 30-minute water spray test, a 4-foot free drop test, a penetration test using a 13-pound weight dropped 40 inches, and a compression test equal to five times the package weight. The present invention easily passed these tests with only superficial damage to the outer drum and no degradation of the inner vessel.

Prior art containers also generally have been able to survive the second phase of testing as specified by 10 CFR 71 Appendix B. These tests are designed to assess the container's ability to maintain containment biological shielding and subcriticality under less severe accident conditions. Tests comprise a 30-foot free drop onto an unyielding surface, a puncture attempt by a 40-inch drop onto a 6-inch diameter blunt steel cylinder, a 30-minute fire in excess of 1475° F., and an 8-hour immersion under at least 3 feet of water. The present invention easily passed these tests with no charing of the inner redwood and no degradation of the inner vessel.

Public Law 94-79 resulted in new, more severe criteria for air transport of plutonium. These criteria are specified in NUREG-0360 (available from National Technical Information Service). The new criteria require a very severe sequence of high-speed impacts followed by new higher levels of crush, slash, fire, and water immersion testing.

In these tests, the container is first impacted perpendicularly onto an unyielding surface at greater than 422 feet/second (290 miles per hour). Results of such an impact are shown in FIG. 4 where (a) is a non-impacted container, (b) has been impacted head on, (c) has been impacted on a corner, and (d) has been impacted from the side. In each test, the outer drum deformed considerably but did not loose its integrity and the inner package is unaffected. The internal load spreader assembly effectively distributed the inertial loads from the internal vessel and the end assembly prevented loss of the lids. The severity of this impact test can be appreciated when it is realized that this impact against an unyielding surface (armorplate on a concrete foundation) is approximately equivalent to a 570 mph impact against soft rock or a 860 mph impact against hard soil.

After the impact test, the deformed container was crushed with a 70,000 pound load applied with a 2-inch wide bar, punctured with a 500 pound spike dropped 10 feet, slashed by a 150-foot drop of a structural steel angle beam, subjected to a fire test, and finally immersed in 3 feet of water for 8 hours.

The fire test comprised subjecting the container to a 2200° F. fire of aviation fuel for at least one hour. The redwood layer, especially that within the load spreader, chars rather than burns in this test, the char thus formed serving to insulate the inner container from thermal extremes.

Each of the above tests were performed in sequence, and thus deteriorated the container far more than performing each test individually. For example, the fire test performed on an undamaged container chars only the outer four inches of redwood.

In addition to the sequential testing, the internal vessel was tested by hydrostatically testing at 600 psi (equivalent to immersion at 1384 feet).

The container passed all tests satisfactorily with no leaks of the contents from the internal vessel and no radiation or nuclear criticality problems.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

We claim:

1. An accident resistant container for shipping materials such as plutonium comprising a tubular steel housing, a metal load spreading tube of shorter length than said housing concentrically disposed within the housing and spaced therefrom having upper and lower end portions inset with respect to corresponding end portions of said housing, a first metal disk inset with respect to the lower end of said tube to provide a projecting skirt portion and secured to the tube forming a bottom support, a metal heat conductor member within said load spreading tube and spaced therefrom with a lower end portion secured to said first disk and projecting upwardly therefrom having an open upper end terminating within said metal tube for positioning and retaining therein a vessel with material such as plutonium therein, a second metal disk inset with respect to the upper end of said tube forming a tube closure and providing a projecting skirt portion, an annular wood filler intermediate said housing and load spreading tube, lower and upper wood fillers having end portions projecting into and abutting against respective of said metal disks and filling respective lower and upper end portions of said load spreading tube and central portions of said annular wood filler, an additional annular wood filler intermediate said load spreading tube and heat conducting member, and lower and upper wood fillers having end portions abutting respective of said metal disks to position said vessel and filling central portions of said additional annular wood filler.

2. The accident resistant container of claim 1 wherein said load spreading tube and said metal disks comprise aluminum and said heat conducting member comprises copper.

3. The accident resistant container of claim 1 wherein said wood fillers comprise grain-oriented redwood.

4. The accident resistant container of claim 1 wherein said tubular steel housing comprise an outer cylindrical steel shell having a chime on each end and an inner cylindrical steel shell adhesively bonded to the interior of said outer shell.

5. The accident resistant container of claim 4 wherein said tubular steel housing further comprise end closures comprising of: A skirted outer lid having a rim corresponding to said chime; a skirted inner lid; a skirted retaining ring for clamping said rim on said chime; and a plurality of bolt means for fastening together said skirt of said retaining ring, said outer shell, said inner shell, said skirt of said outer lid, and said inner lid.

* * * * *